United States Patent [19]

Johnson, Sr.

[11] 4,144,528

[45] Mar. 13, 1979

[54] ALARM SYSTEM

[75] Inventor: Robert D. Johnson, Sr., Newport Beach, Calif.

[73] Assignee: CompAlarm Systems Co., Laguna Beach, Calif.

[21] Appl. No.: 755,339

[22] Filed: Dec. 29, 1976

[51] Int. Cl.[2] ..... G08B 26/00

[52] U.S. Cl. ..... 340/500; 340/505; 340/518

[58] Field of Search ..... 340/213 R, 409, 408, 340/276, 151, 164R

[56] References Cited

U.S. PATENT DOCUMENTS

| | | | |
|---|---|---|---|
| 3,307,166 | 2/1967 | Slack et al. | 340/213 R |
| 3,618,069 | 11/1971 | Evans | 340/409 |
| 3,641,547 | 2/1972 | Reiss et al. | 340/409 |
| 3,699,569 | 10/1972 | Lee | 340/409 |
| 3,702,474 | 11/1972 | Fink et al. | 340/409 |
| 3,706,987 | 12/1972 | West et al. | 340/409 |
| 3,716,834 | 2/1973 | Adams | 340/409 |
| 3,811,126 | 5/1974 | Winger | 340/409 |

*Primary Examiner*—John W. Caldwell, Sr.
*Assistant Examiner*—Donnie L. Crosland
*Attorney, Agent, or Firm*—Patrick F. Bright; Elwood S. Kendrick

[57] ABSTRACT

An alarm system includes: (1) a central station having power generating means and alarm registering means, and (2) a plurality of alarm-producing systems in locations remote from the central system, each electrically connected to the central station through a single pair of conductors, and each including circuitry for producing up to eight separate alarm conditions as the power generating means alternately impresses a first predetermined DC voltage on each pair of conductors simultaneously, then interrupts voltage to all conductors simultaneously, impresses a second predetermined DC voltage only on the first of each pair of conductors simultaneously, and again interrupts voltage to all conductors simultaneously.

12 Claims, 3 Drawing Figures

ALARM SYSTEM

This invention relates to alarm-detecting systems, and particularly to systems where a plurality of alarm-producing locations may be monitored from a central station.

An object of this invention is to provide alarm-producing, alarm-detecting systems that may be readily and economically installed in a plurality of locations, and adapted to transmit up to eight separate combinations of alarm conditions to a central system that constantly monitors and detects alarm conditions at each of the alarm producing locations.

Another object is to provide an alarm-producing, alarm-detecting systems where none of the alarm-producing systems requires a power source at the location where that system is installed.

Another object is to provide an alarm-producing system that may be connected to a central alarm monitoring system by a single pair of conductors such as telephone wires.

Another object is to provide an alarm system wherein a plurality of alarm-producing systems at different locations constantly produce signals indicating whether or not up to eight combinations of alarm conditions exist at each location, and transmit such signals to a central alarm-detecting system where that data may be detected and interpreted as digital data, and may be continuously scanned and analyzed by such high speed devices as computers.

This invention provides an alarm system comprising a central system including: (1) power generating means and alarm-detecting means, and (2) a plurality of alarm-producing systems, each remote from, and electrically connected to, the central system by a single pair of conductors. The power-generating means comprises means for alternately: (a) impressing a first predetermined DC voltage simultaneously on the first and second of each conductor air, (b) simultaneously interrupting voltage to all conductors, (c) simultaneously impressing a second predetermined DC voltage on only the first conductor of each conductor pair, and (d) again simultaneously interrupting voltage to all conductors. The power generating means repeats these four cycles continuously at the command of means for controlling the sequence of and time interval for each cycle.

Each alarm producing system includes: (a) a first and second conductor electrically connected to the central system, (b) means electrically connected to the first conductor for maintaining at least a minimum voltage on that first conductor when no voltage is impressed thereon, (c) discharge means including first switch means for grounding the voltage maintaining means when the first switch means is closed, (d) means for electrically connecting the first conductor to the second upon closing of second switch means to permit current flow from the central system through the first conductor, second switch means, and second conductor to the central system, and (e) means for electrically grounding the second conductor upon closing of third switch means.

The alarm-detecting means comprises means for detecting voltage variation on the first conductor of each pair, means for sensing current flow from the first to the second of any conductor pair upon closing of the switch means between those conductors, and means for detecting current flow through the second conductor of any pair to ground at the alarm-producing location upon closing of the third switch means.

The power-generating means is preferably electrically connected to a timer circuit that cyclically impresses a predetermined DC voltage simultaneously on both conductors of each pair for a predetermined interval, simultaneously interrupts current flow to all conductors for a predetermined interval, then impresses a second predetermined DC voltage only on the first conductor of each conductor pair for a predetermined interval, and then again interrupts a current flow to all conductors for a predetermined interval before repeating the sequence. This sequence is sometimes hereafter called the power-generating cycle.

While a first predetermined DC voltage is impressed at the central system on both conductors in each conductor pair in the first cycle of the power generating cycle, current flows from the power source of the central station simultaneously through the first conductor of each pair to each alarm-producing system, and charges the grounded capacitor electrically connected to that first conductor at each such location. When the first cycle of the power-generating cycle ends, and voltage is no longer impressed on any conductor, each grounded capacitor tends to discharge. If the first switch means in the discharge means for the grounded capacitor is open, the capacitor tends to minimize a drop in voltage on the first conductor between the capacitor and the central system, at least for the brief interval during the power-generating cycle that no power is impressed on the first conductor. The central system constantly monitors the voltage on the first conductor of each pair of conductors, and interprets a voltage above a predetermined minimum on that conductor as a no-alarm condition at the alarm-producing location.

When the first switch means in the capacitor-discharging circuit is closed, which may occur when an unauthorized intruder enters the alarm-producing location, or when a fire begins at that location, or other alarm condition arises, the capacitor will be rapidly discharged to ground at the alarm-producing location, and the voltage on the first conductor will drop below the predetermined minimum during that portion of the power-generating cycle when no voltage is impressed on the first conductor. This voltage drop on the first conductor will be detected at the central system and interpreted as an alarm condition at the alarm-producing location. The same voltage drop takes place where the first conductor is opened or short-circuited between the central system and the alarm-producing system.

Because the second of each conductor pair is normally ungrounded, no current will flow through that conductor to ground at the alarm-producing location during the first cycle of the power-generating cycle. This absence of current flow is detected at the central system, and interpreted as a no-alarm condition at the alarm-producing location. However, each alarm-producing system may be electrically connected to ground through a normally-open second switch means at the alarm-producing location. Closing that second switch means, as in response to an alarm condition different from the alarm condition detected as a change in voltage on the first conductor, will permit current flow to ground at that location through the closed second switch means. This current flow will be detected at the central system, and interpreted as an alarm condition at the alarm-producing location.

After the first cycle of the power-generating cycle ends, voltage is temporarily interrupted to all conductors in the second cycle to permit the system to stabilize. In the third cycle, a second predetermined DC voltage, which may be the same as or different from the first, is impressed simultaneously on only the first of each pair of conductors. If the third switch means at any alarm-producing location is open, no current flow from the central system to that location can occur. This absence of current flow is detected at the central system, and interpreted as a no-alarm condition. Typically, this condition is different from the alarm condition detected as voltage variation on the first conductor, and from the condition detected as current flow through the second conductor and second switch means to ground. If the third switch means between the first and second conductors is closed during the third cycle of the power-generating cycle, current will flow between them and back to the central system. This flow will be detected there and interpreted as an alarm condition at the alarm-producing location.

Because there are three separate alarm-producing means at each alarm-producing location, the new system can simultaneously identify, at the central system, up to eight combinations of alarm/no-alarm conditions at each location. These combinations include no alarm conditions of any kind at a location, three alarm conditions at that location, and all the combinations between the two, such as a first alarm condition but no second or third alarm condition, a second alarm condition, but no first or third alarm condition, and a third alarm condition but no first or second alarm condition.

The central alarm detecting system may be adapted to detect all eight such combinations, or fewer, as desired. For example, as FIG. 3 shows, the alarm-detecting means of the central system may include three or more OR gates for receiving signals from each circuit at each alarm-producing location, for interpreting these signals as digital data, and for transmitting the data to a plurality of latch gates. Until an alarm condition arises and is detected at the central station, digital data simply passes through the OR and latch gates to means such as a seven-segment decoder/driver which produces a signal such as a numeric readout indicating that no alarm condition exists. If an alarm condition arises at any location, the output from the OR gates at the central system changes from logic state 1 to logic state 0. That changes the latch gate output from logic 0 to logic 1, indicating an alarm condition, and simultaneously precludes transmission of any other alarm condition from that same location until the alarm condition so latched is unlatched.

Referring now to the drawings.

Figure 1:
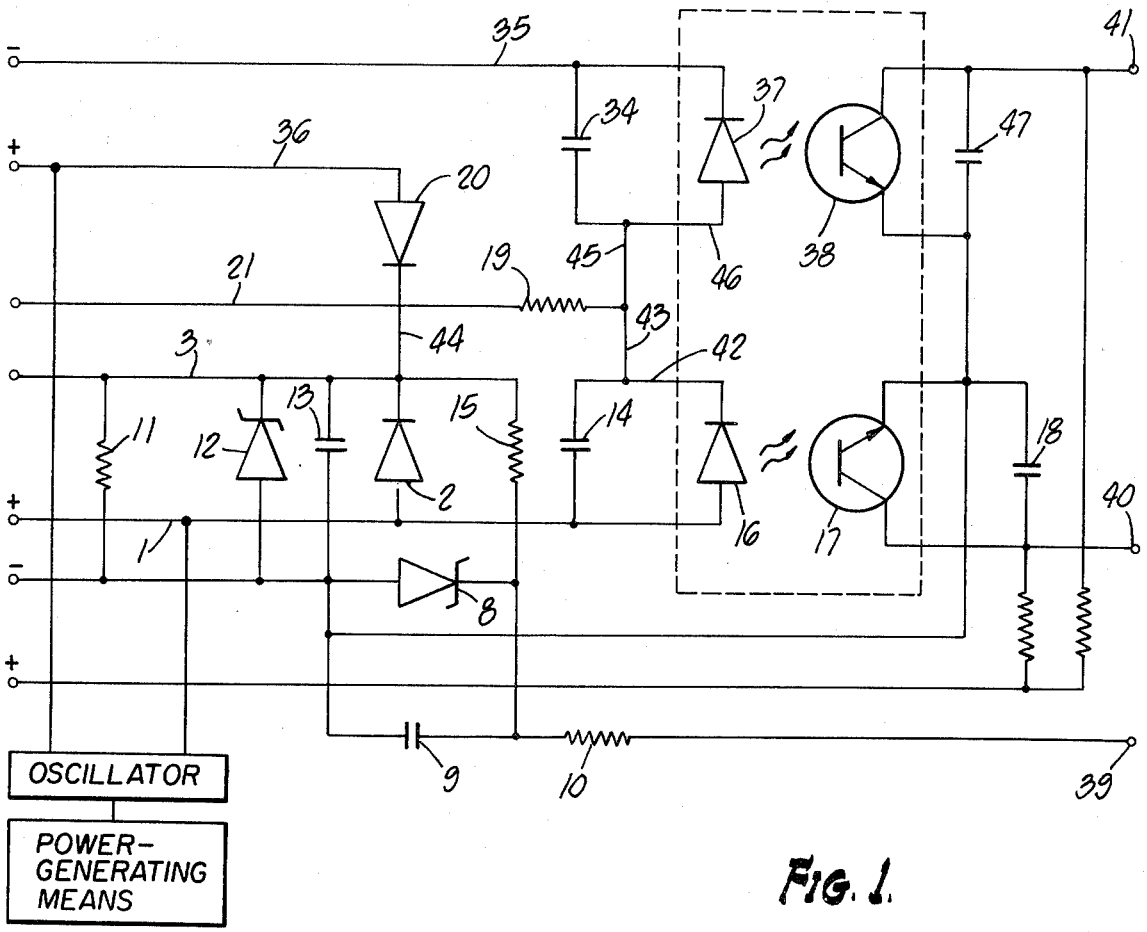
FIG. 1 shows one embodiment of a portion of the central alarm-detecting system.
Figure 2:
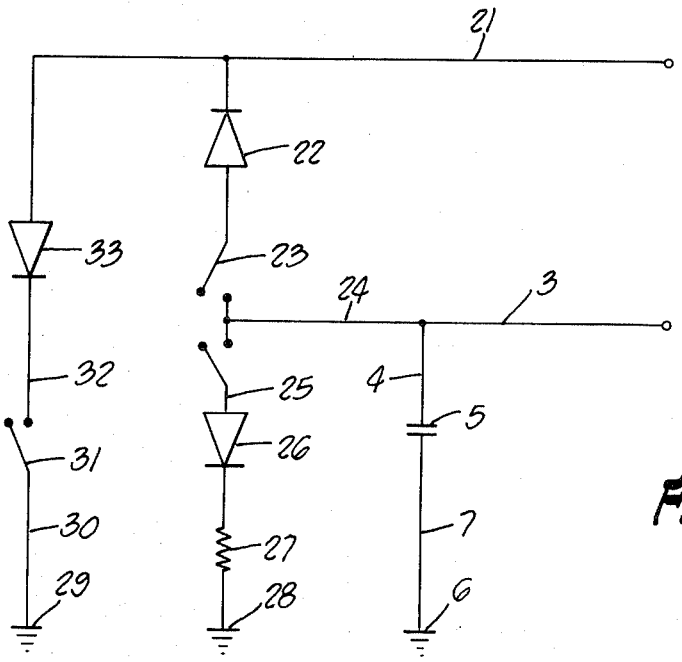
FIG. 2 shows one embodiment of the alarm-producing system.

Referring now to FIGS. 1 and 2, where only one pair of conductors and one alarm-producing unit of the plurality of such units that make up this new alarm system is shown, a power-generating means 100 is electrically connected to a timer means 101 that produces a power-generating cycle. In the first cycle of this power-generating cycle, voltage is simultaneously impressed on both conductors of each conductor pair in the system. Here, lines 3 and 21 are the conductor pair, and during the first cycle, current flows from the power-generating source at the central station to the alarm-producing system through first conductor line 1 and diode 2 at the central system, and then to the alarm-producing location through conductors 3 and 4 to capacitor 5, which may have a capacitance of about 30 $\mu$F or higher. Capacitor 5 is electrically connected to ground through conductor 7. During the first cycle, capacitor 5 accumulates a minimum charge which is detected at point 39 at the central station, and interpreted there as a no-alarm condition. Zener diode 8, capacitor 9 and resistor 10 restrict the voltage at point 39 from raising higher than a predetermined maximum, and thus damaging the logic circuits shown in FIG. 3.

During the second cycle of the power-generating cycle, voltage is interrupted on all conductors, and capacitor 5 tends to discharge. If switch means 25 is open, and conductors 3 and 4 are intact, capacitor 5 tends to maintain the voltage on conductors 4 and 3 above a predetermined minimum, thus maintaining the voltage at point 39 above a certain predetermined minimum until power is again impressed upon the first conductor. This minimum voltage in the first conductor indicates that no alarm condition has arisen at the alarm-producing location. If line 3 is cut or short-circuited between the central station and the alarm-producing location, the voltage on conductor line 3 promptly drops substantially. That condition is detected at point 39, and interpreted as an alarm condition at the alarm-producing location. If first switch means 25 is closed during any cycle other than the first cycle, the charge stored in capacitor 5 flows through conductors 4 and 24, switch means 25, diode 26 and resistor 27 to ground 28. This rapid dissipation of the charge on capacitor 3 results in a rapid voltage drop at point 39, which is detected and interpreted as an alarm condition at the alarm-producing location.

During the same first cycle of the power-generating cycle, voltage is also impressed on conductor 21, but no current will flow if second switch means 31 is open at the alarm-producing location. Lack of current flow through the second conductor line 21 during this first cycle is detected at point 40 at the central station and interpreted as a no-alarm condition. Closing of switch means 31 indicates an alarm condition has arisen at the alarm-producing location, and results in current flow through diode 16, conductors 42 and 43, resistor 19 and conductor 21. This current flow is detected by the current sensor, here an optoisolator that includes light emitting diode 16 and photo-transistor 17 and read at point 40 as an alarm condition.

After the first cycle ends, after perhaps 0.1 second, the timer means 101 interrupts voltage to all conductor pairs for a brief interval, perhaps 0.05 second. During the third cycle of the power-generating cycle, the power-generating means 100 impresses voltage on line 36 only. However, no current will flow from the central station to the alarm-producing system if switch means 23 is open. This lack of current flow is detected by the current sensor, here an optoisolator that includes light emitting diode 37 and phototransistor 38, and is interpreted as a non-alarm condition at the alarm-producing location. If third switch 23 is closed, as in response to the occurrence of an alarm condition at the alarm-producing location, current will flow during the third cycle from the central station through conductor 36, diode 20, conductor 44 and conductor 3 to the alarm-producing location. There, the current flows through conductors 3 and 24, switch 23, diode 22, back to the central system through conductor 21, resistor 19, conductors 44 and 46, diode 37, and then to ground through conductor 35. Current flow through light emitting diode 37 is detected by phototransistor 38 at point 41, and interpreted as an alarm condition at the alarm-producing location.

Figure 3:
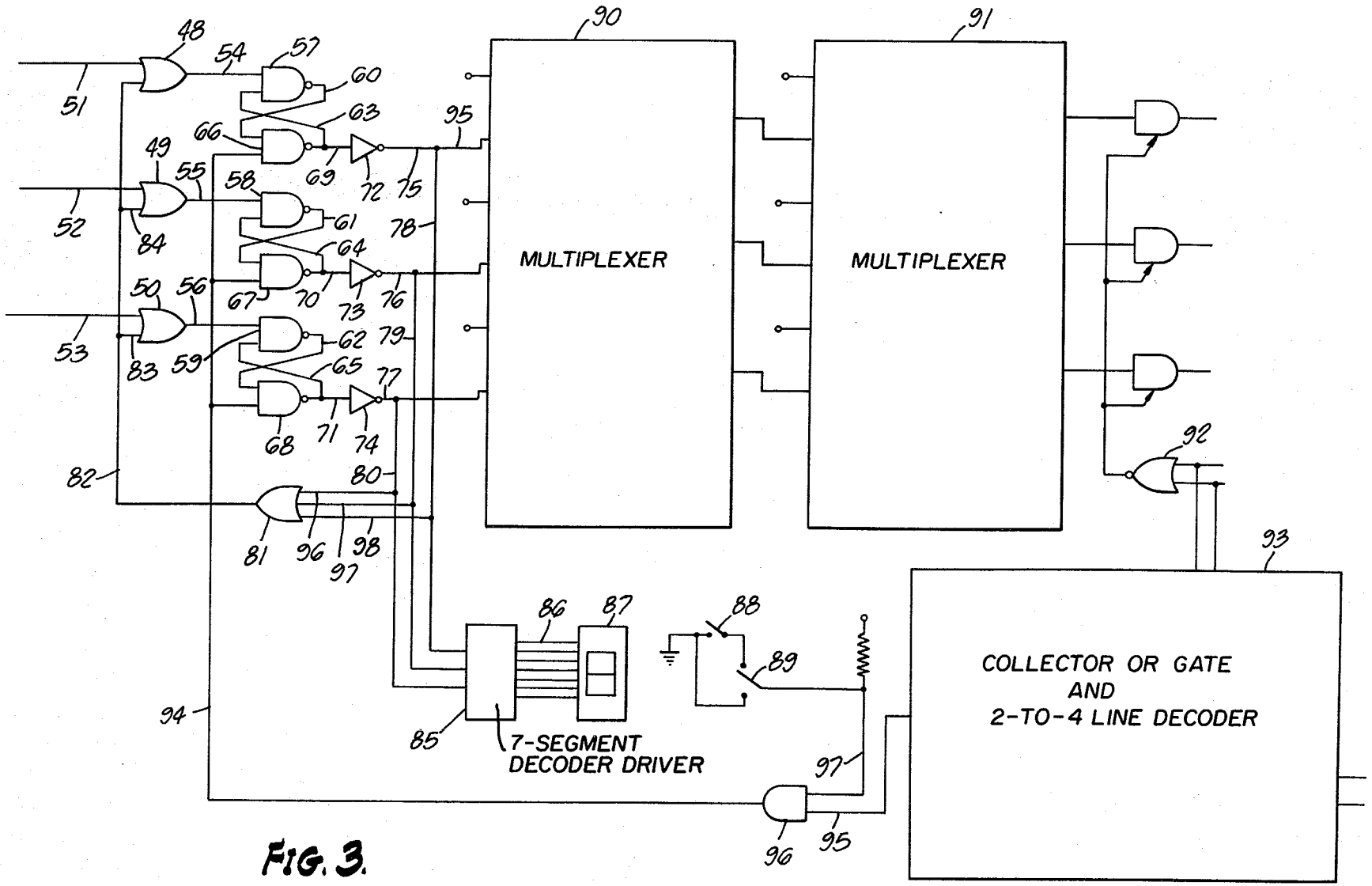
FIG. 3 shows an embodiment of another portion of the central alarm-detecting means.

Referring now to FIG. 3, digital data from an alarm-producing system transmitted to points 41, 40 and 39 pass via lines 51, 52 and 53, respectively, to OR gates 48, 49 and 50, respectively. Where no alarm condition exists at the location of the alarm-producing system served by lines 51, 52 and 53, the input to OR gates 48, 49 and 50 from these lines will be at logic state 1. The other input to gates 48, 49 and 50, carried by lines 82, 82 and 84, and 82 and 83, respectively is normally at logic state 0. Thus, the output from these OR gates is normally at logic state 1. Where an alarm condition arises in the alarm-producing system, the input to the associated OR gate 48, 49 or 50 changes from normal logic state 1 to alarm logic state 0. Thus, for example, an alarm condition causing current to flow through light emitting diode, which causes transistor 38 to change the input to OR gate 48, on line 51, from normal logic state 1 to alarm logic state 0. The output of OR gate 48 then changes from normal logic state 1 to alarm logic state 0, and is input to NAND gate 57 via line 54.

Because the other input to NAND gate 57 from line 63 is normally at logic state 1, the change from logic state 1 to alarm logic state 0 on line 54 changes the output from NAND gate 57 from normal logic state 0 to alarm logic state 1 to signal the alarm condition at the alarm-producing location. That output from NAND gate 57 becomes one input to NAND gate 66. The other input to NAND gate 66, via line 94, is normally at logic state 1. Thus, the change to alarm logic state 1 on line 60 changes the output from NAND gate 66 from normal logic state 1 to alarm logic state 0. That output, on line 69, is fed to NAND gate 57 via line 63. This insures that the output from NAND gate 57 will remain latched at alarm logic state 1 until line 63 is reset to logic state 1, regardless of the change, if any, in the inputs to NAND gate 57 from line 54. Inverter 72 inverts the output from NAND gate 66, and this output passes via conductor 75 to seven-segment decoder/driver 85 through line 78, or to multiplexers 90 and 91 through line 95. This same output also passes to OR gate 81 via line 98. Because the inputs to OR gate 81 are normally all at logic state 0, the output from OR gate 81 is normally at logic state 0. However, the change from normal logic state 0 to alarm logic state 1 on line 98 changes the output from OR gate 81 from normal logic state 0 to alarm logic state 1. This output is fed to OR gates 48, 49 and 50 through conductors 82, 82 and 84, and 82 and 83, respectively, thus locking out from these OR gates any new alarm from the alarm-producing system.

Where the output on line 75 passes to the seven-segment decoder/driver 85, the signal is converted by the decoder and fed to seven-segment display device 87 where a number appears corresponding to the alarm condition that exists at the alarm-producing location.

Where a computer-based system is used to monitor the output from the alarm-producing units, the output from line 95 is fed with the outputs from the same alarm-producing system to multiplexing circuits 90 and 91. These select, from among the four alarm-producing units on each IC card in the alarm-detecting system, the three lines from the alarm-producing system to be scanned when addressed by the computer. With the data from the multiplexers, the computer addresses, via NOR gate 92, the IC card and IC card rack corresponding to the alarm-producing system the computer is scanning, and transmits the alarm condition to a readout device such as a cathode ray tube.

Upon command from the computer, the rack and card addresses are collector-ORed in circuit 93 with a reset signal generated by the computer that enables a two-line to four-line decoder in circuit 93 to reset the latch through which the alarm condition passed. The decoder effects this change by imposing a 0 logic state, via line 95, upon AND gate 96. Combined with the 0 logic state imposed on AND gate 96 via line 97, AND gate 96 produces a 0 logic state output on line 94. This output is imposed on NAND gates 66, 67 and 68, and resets the output of these gates from alarm logic state 0 to normal logic state 1.

These outputs are also fed via line 75-78-98, 76-79-97, and 77-80-96, to OR gate 91, which changes its output from alarm logic state 1 to normal logic state 0. That output passes to OR gate 48, 49 and 50 via lines 82, 82-84, and 82-83, enabling these gates to again transmit alarm conditions from the alarm-producing system served by lines 51, 52 and 53. It is apparent that disconnecting line 82 from any of OR gates 48, 49 and 50 will permit the transmission of two or more alarm conditions simultaneously or sequentially to the latch gates, and this is another embodiment of this invention.

What is claimed is:

1. An alarm system comprising:

a central system including power-generating means and alarm-detecting means, and at least one alarm-producing system remote from and electrically connected to said central system by a single pair of conductors comprising a first conductor and a second conductor, said alarm-producing system also comprising first switch means, second switch means and third switch means, said central power-generating means including means for alternately impressing a first predetermined DC voltage simultaneously on the first and the second conductor of said pair of conductors, interrupting voltage entirely, and impressing a second predetermined DC voltage only on said first conductor of said pair of conductors, said alarm-producing system comprising, means electrically connected to said first conductor for maintaining at least a minimum voltage on said first conductor when no voltage is impressed on said first conductor, and discharge means including said first switch means for electrically connecting to ground the said means for maintaining at least a predetermined voltage on the first conductor, means for electrically connecting the first conductor to the second conductor of said pair of conductors upon closing of said second switch means between them to permit current flow from said central system through said first conductor, said second switch means and said second conductor to said central system, and means for electrically connecting the second of said pair of conductors to ground upon closing of said third switch means to permit current flow from said central system through said second conductor to ground at the alarm-producing location.

2. The alarm system of claim 1 in which said central alarm-detecting system comprises means for sensing voltage variation on said first conductor, means for sensing current flow from the first to the second of said pair of conductors upon closing of said second switch means, and means for sensing current flow through said second conductor to ground upon actuation of said third switch means.

3. The system of claim 1 wherein said means for maintaining at least a minimum voltage on said first conductor is a grounded capacitor.

4. The system of claim 1 wherein said central power-generating means comprises an oscillating power source.

5. The system of claim 2 wherein said central alarm-detecting system comprises means for interpreting electrical signals from the means for sensing voltage variation and from the means for sensing current flow s digital data, and for electrically transmitting said digital data to means for memorizing said digital data upon detection of at least one alarm condition, means for memorizing said digital data where said digital data indicates at least one alarm condition from an alarm-producing system, and means for electrically preventing transmission of another alarm from said alarm-producing system while said memorizing means retains the memory of said at least one alarm from said alarm-producing system.

6. The system of claim 5 wherein said central alarm-detecting system comprises resetting means for electrically erasing from said memorizing means the said at least one alarm condition, and for reactivating the means for interpreting and transmitting signals from the means for detecting voltage variation and current flow.

7. The system of claim 6 wherein said resetting means is operable through computer-programmed commands.

8. The alarm system of claim 5 wherein said central alarm-detecting system further comprises means for interpreting digital data from each alarm-producing system as any one of eight possible alarm combinations.

9. An alarm system comprising:

a central system including power-generating means and alarm-detecting means, and at least one alarm-producing system remote from and electrically connected to said central system by a single pair of conductors comprising a first conductor and a second conductor, said central power-generating means including means for alternately impressing a first predetermined DC voltage simultaneously on the first and the second conductor of said pair of conductors, interrupting voltage entirely, and impressing a second predetermined DC voltage only on the first conductor of said pair of conductors, said alarm-producing system comprising three separate alarm-producing means which includes first, second and third switch means in said alarm-producing system for simultaneously identifying, at said central system, up to eight combinations of alarm/no-alarm conditions at said location.

10. The alarm system of claim 9 wherein one of said three separate alarm-producing means comprises means electrically connected to said first conductor for maintaining at least a minimum voltage on said first conductor when no voltage is impressed on said conductor, and discharge means including first switch means for electrically connecting to ground the said means for maintaining at least a predetermined voltage on the first conductor.

11. The alarm system of claim 10 further comprising means for electrically connecting the first conductor to the second conductor of said pair of conductors upon closing of second switch means between them to permit current flow from said central system through said first conductor, said second switch means and said second conductor to said central system.

12. The alarm system of claim 11 further comprising means for electrically connecting the second of said pair of conductors to ground upon closing of a third switch means to permit current flow from said central system through said second conductor to ground at the alarm-producing location.

* * * * *